United States Patent [19]

Frehaut et al.

[11] Patent Number: 4,920,887

[45] Date of Patent: May 1, 1990

[54] SYSTEM FOR MAINTAINING MULTIPLE WARHEADS PLACED IN A MISSILE ROTATING ON ITS LONGITUDINAL AXIS

[75] Inventors: Jean-Pierre Frehaut; Eric Magnaudet; Jean-Pierre Pineau, all of Orleans, France

[73] Assignee: Thomson-Brandt Armements, Boulogne Billancourt, France

[21] Appl. No.: 201,853

[22] Filed: Jun. 3, 1988

[51] Int. Cl.[5] ..... F42B 13/50

[52] U.S. Cl. ..... 102/489; 102/357; 102/393

[58] Field of Search ..... 102/340, 342, 351, 357, 102/377, 378, 393, 473, 489, 505

[56] References Cited

U.S. PATENT DOCUMENTS

| | | | |
|---|---|---|---|
| 2,970,542 | 2/1961 | Pigman . | |
| 3,016,011 | 1/1962 | Brown . | |
| 3,088,404 | 5/1963 | Brown et al. . | |
| 3,834,312 | 9/1974 | Simmons . | |
| 4,389,940 | 6/1983 | Trembly | 102/489 |
| 4,480,552 | 11/1984 | Eckel | 102/393 |
| 4,638,737 | 1/1987 | McIngvale | 102/489 |
| 4,714,020 | 12/1987 | Hertsgaard | 102/351 |
| 4,754,706 | 7/1988 | Fauvel et al. | 102/489 |

FOREIGN PATENT DOCUMENTS

| | | | |
|---|---|---|---|
| 0130893 | 1/1985 | European Pat. Off. . | |
| 0195854 | 1/1987 | European Pat. Off. . | |
| 3506889 | 8/1986 | Fed. Rep. of Germany | 102/489 |

*Primary Examiner*—Harold J. Tudor

*Attorney, Agent, or Firm*—Oblon, Spivak, McClelland, Maier & Neustadt

[57] ABSTRACT

Disclosed is a system for the holding of multiple warheads, placed in a missile rotating on its longitudinal axis and dropped in trajectory through an end of the missile. Each stage of the warhead includes at least two distinct parts which have to be separated laterally at the moment of dropping, the missile including a casing inside which the warhead is placed. For each stage, mechanisms to fix the parts at the said stage are arranged so that each stage forms a compact unit so as not to cause major radial stresses against the casing due to the centrifugal force created by the rotating missile. The fixing mechanisms are retractable at the moment when the parts are dropped, by means of inertia blocks that are subjected to the centrifugal force. The invention can be applied to sub-munitions and mortar shells.

12 Claims, 4 Drawing Sheets

FIG_4
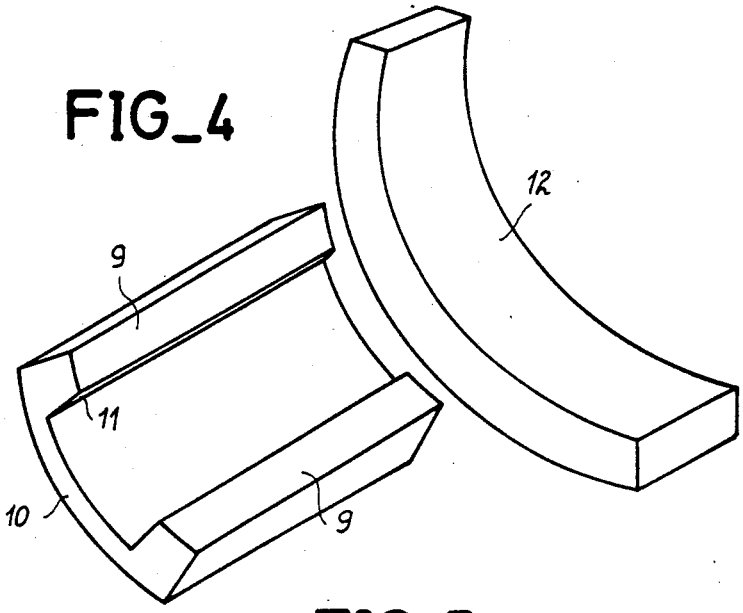
FIG_5
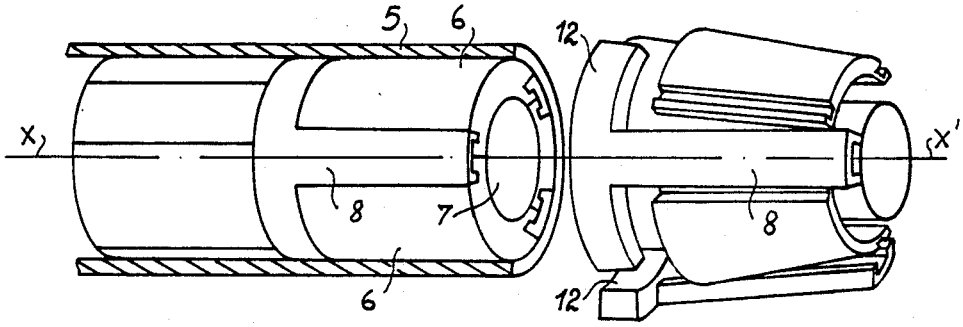
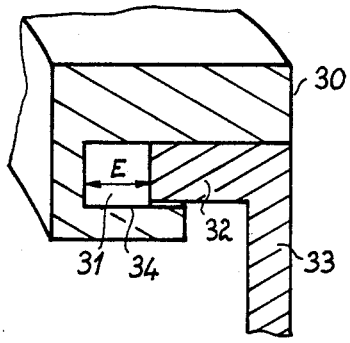
FIG_6

4
X'
X
20
18
21
5
a
b

Section b
5
21

Section a
5
18
20

SYSTEM FOR MAINTAINING MULTIPLE WARHEADS PLACED IN A MISSILE ROTATING ON ITS LONGITUDINAL AXIS

BACKGROUND OF THE INVENTION

1. Field of the Invention

The invention relates to payloads consisting of multiple and/or heterogeneous warheads such as sub-munitions placed in a missile rotating on its longitudinal axis. These payloads have to be released in trajectory and, hence, their arrangement inside the missile is designed so as to make the constituent elements separate at the moment that they are dropped. The invention is more especially suited to resolving problems concerning missiles that consist of mortar shells rotating at very high speed (more than 1000 rpm).

2. Description of the Prior Art

In a mortar shell, the mechanical stresses which are caused by acceleration and to which the shell is subjected at the moment of firing are particularly intense, and it is very difficult for the mechanical structure placed in the shell to withstand them: if several sub-munitions are placed behind one another, with the first sub-munition resting on the second, the second on the third and so on, the pressure to which the last sub-munition is subjected by the other sub-munitions at the moment of firing is such that this last sub-munition cannot withstand this mechanical stress.

It has already been envisaged that each sub-munition could be reinforced in a manner depending on the row occupied by it in the stack, within the missile, so as to withstand the pressure exerted by the preceding sub-munitions. The major disadvantage of this method is that the place within each sub-munition, intended for the very function of this sub-munition, keeps diminishing or even becomes non-existent.

One approach already proposed to resolve this problem consists in a stacking of sub-munitions wherein each sub-munition has, as shown in FIG. 1, a supporting element consisting of two ties 2A and 2B which can be separated at the moment of dropping to release the sub-munition. These two ties each have a reinforcement piece 3A and 3B at their rear to support the sub-munition at the starting instant. Thus, the inertial forces when the shot is fired, due to each sub-munition, are supported solely by their two respective ties. Each tie is in contact with the following one. The forces thus accumulated are transmitted to the back 4 of the missile.

One of the disadvantages of this type of assembly is shown in FIG. 2. FIG. 2 shows the same elements as those shown in FIG. 1, but during the dropping stage. Ejection takes place through the rear of the casing 5 of the projectile, along the longitudinal axis X, X', the back 4 being detached from the casing. After this, come the last two ties 2A and 2B supporting the sub-munition 6. It is seen that the rear portions 3A and 3B of the last two ties are subjected to centrifugal force due to the high rotational speed of the entire missile, the sub-munitions and their ties. When a sufficient length of the ties has been released from the casing 5, these ties move away from each other and create a jamming which blocks them between their own sub-munitions 6 and the casing 5 of the missile, thus slowing down the dropping operation and all the following sub-munitions and thus possibly damaging the sub-munitions.

Another disadvantage of this system is that, under the effect of the rotational speed of the entire missile on its longitudinal axis, the ties 2A and 2B, subjected to the centrifugal force, are pushed against the internal wall of the casing and create frictional forces between the ties and the casing. This considerably slows down any longitudinal translation of the sub-munitions, surrounded by their ties, and hinders the dropping of the sub-munitions.

An object of the invention is to remove these drawbacks by creating a new system to maintain the payload within the missile while, at the same time, enabling this payload to be easily dropped.

SUMMARY OF THE INVENTION

To this end, the invention is a system for holding a payload consisting of multiple and/or heterogeneous warheads, placed in a missile that rotates on its longitudinal axis and dropped in trajectory through an end of said missile, said payload comprising at least one stage, comprising at least two distinct parts which have to be separated at the moment of dropping, said missile comprising a casing within which the said payload is placed, said system comprising, for each stage, means to fix the parts of said stage so that each stage forms a compact unit so as not to cause major radial stresses against the casing due to the centrifugal force created by the rotating missile, said fixing means being retractable at the instant when the parts are dropped.

DESCRIPTION OF THE DRAWINGS

The invention and its features will be better understood from the following description and the appended figures, of which:

FIG. 4 shows a holding part, called a U-bracket, used in the system according to the invention;

FIG. 5 shows an explanatory diagram pertaining to the system according to the invention;

FIG. 6 shows a partial sectional view of an alternative embodiment of inertia blocks;

DESCRIPTION OF THE INVENTION

Figure 1:
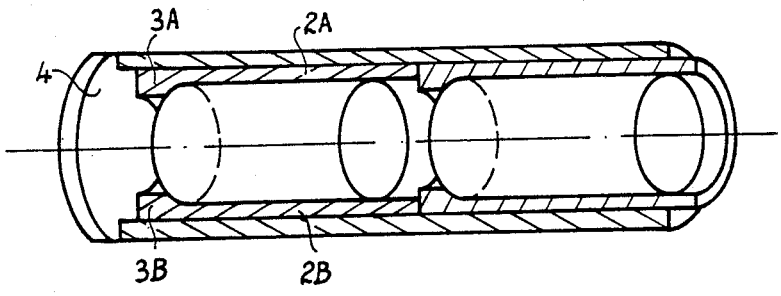
FIG 1 PRIOR ART
FIGS. 1 and 2 show a system to hold multiple warheads inside a missile before and during the dropping operation.
Figure 2:
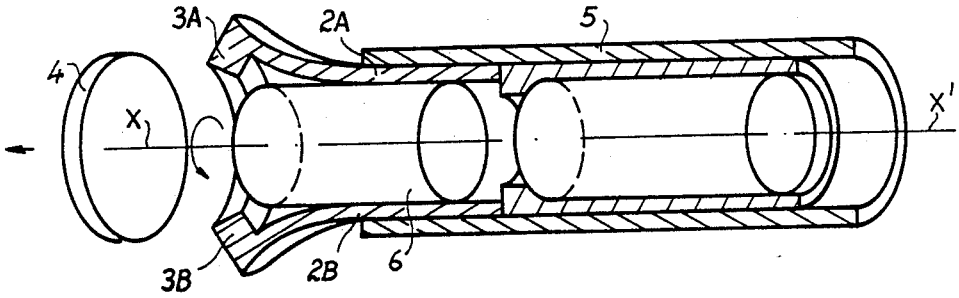
FIG 2 PRIOR ART
Figure 3:
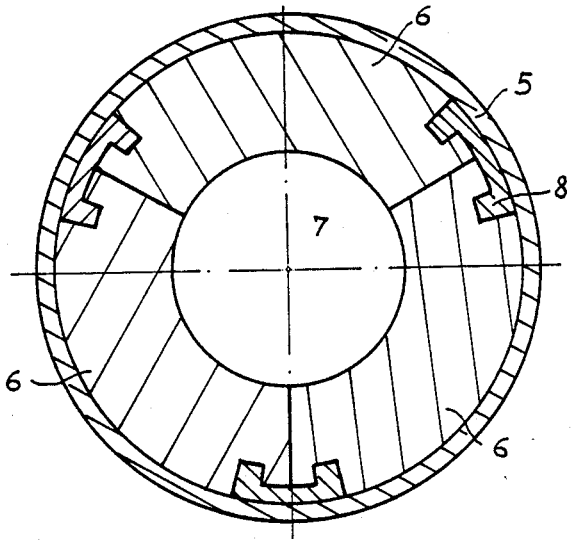
FIG. 3 shows a first drawing relating to a system according to the invention.

With reference to FIG. 3, the principle of the system according to the invention is based on the fact that the various parts of a stage of a stack, in this case the ties 6 and their sub-munitions 7, should constitute a compact stage before being dropped so that casing 5 is not made to undergo major radial stresses due to the centrifugal force created by the missile rotating on its longitudinal axis. Fixing means 8 should be provided and should also be retractable at the dropping moment, so that these various parts can spread out laterally and freely owing to the centrifugal force.

A possible embodiment of these fixing means consists in the use of U-shaped structures, hereinafter called U-brackets. These parts are rigid enough to hold the various parts of one and the same stage and are placed on the edge of the unit. Referring to FIG. 4, these U-brackets, seen cross-sectionally, have two side blocks (or sides) 9. Each of said sides 9 goes inside a corresponding notch in one of the parts 6, which have to be kept assembled. These sides are joined to each other by a central part 10 which is of a smaller thickness. The shape of the sides of the U-bracket is such that, under the effect of the centrifugal force of its components and the frictional forces thus generated, all the U-brackets and the parts that are connected by these U-brackets remain naturally joined to each other. This may be done, for example, by making a slight dovetail shape in the U-brackets.

To split up the unit, the U-brackets are each associated with ejection means. So as to work solely under the effect of the centrifugal force, these ejection means are made up of an inertia block 12, the mass of which is subjected to the centrifugal force and thus enables a U-bracket to be pulled away. Furthermore, this mass should not be excessive, in order to prevent the centrifugal force applied to it from causing the disturbing friction, against the casing 5, already referred to with respect to prior art devices. Each inertia block is associated with a U-bracket. FIG. 4 shows no fixing means between the U-bracket and the inertia block, and the inertia block 12 may be an integral part of the U-bracket 10. Fixing means may, however, be envisaged between these two parts, for example, fixing means using pins or screws placed parallel to the axis of the casing 5.

To prevent the jamming phenomenon referred to above, during exiting of a part such as a U-bracket with a relatively large inertia block 12, it is provided that the inertia block will be placed behind the U-bracket, i.e. this inertia block 12 is the last part of the U-bracket to leave the casing 5 (see FIG. 5).

It is also possible that the inertia block will pull the U-bracket along with it after an inward travel. For, referring to FIG. 6, the inertia block 30 has a ring-shaped groove 31, which is deep enough to enable a projecting ring-shaped part 32 of the U-bracket 33 to penetrate it by several millimeters without filling a radial space E. The side 34 of the groove 31, placed between this groove 31 and the U-bracket, has a small diameter to enable an outward translational motion of the inertia block 30, permitted by the presence of the space E. In this way, when the inertia block is released from the casing, it spreads outwards as above. At the start of its travel along the space E, it gains sufficient kinetic energy to pull the U-bracket 33 away from from the parts that it holds before the dropping operation.

It can be observed, therefore, that the U-bracket should be brought out entirely so that it can be ejected from the parts 6 to be separated. This, therefore, prevents the jamming of any part while it is leaving the casing. The separation of the parts, after all the U-brackets have been pulled away, takes place through the centrifugal force applied to each of the parts 6.

Figure 7:
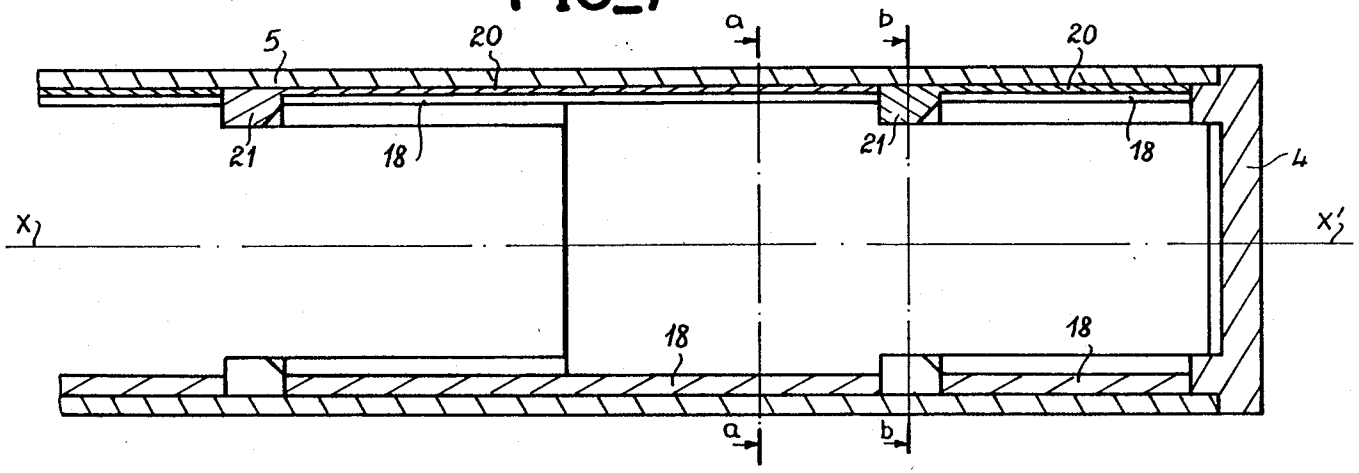
FIG. 7 shows a system according to the invention applied to a missile and to sub-munitions, again according to the invention.
Figure 8B:
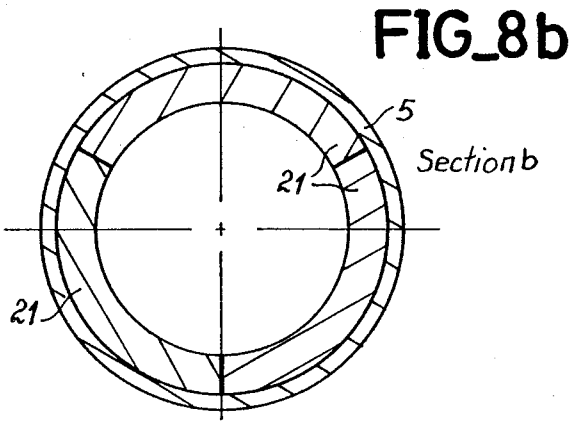
FIGS. 8A and 8B show two cross-sections of the missile described in FIG. 7.
Figure 8A:
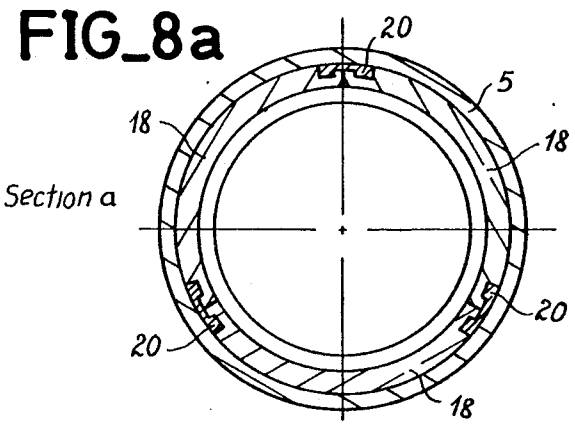

Referring to FIGS. 7, 8A and 8B, the system according to the invention can be applied as follows to a missile containing sub-munitions. These figures repeat the main elements of FIGS. 3, 4 and 5, namely the casing 5, the U-brackets 20 and their inertia block 21. It will be noted in FIGS. 7 and 8B that the thickness of the inertia blocks is greater than the corresponding U-brackets 20. However these inertia blocks extend over a maximum peripheral sector forming a continuous circular ring so that they touch one another. The effect of this is to considerably increase the mass of these inertia blocks. Consequently, they can also support the corresponding sub-munition 6. The ties 18 only position the sub-munitions coaxially. As FIG. 8B shows, the inertia block 21 no longer fulfils the function of hooking the ties 18, and is therefore subjected to the centrifugal force without being held by the sub-munition 6, so that, when during the dropping operation, it carries the rest of the U-bracket 20 with it. The sub-munitions, in this example, have been shown in two parts with different diameters, lying on inertia blocks. They are shown approximately at mid-length on each sub-munition. This is an embodiment where each sub-munition can be supported either by the inertia block or by the tie, at one end of the sub-munitions as well as at its center. However, in this example, with the sub-munitions 7 resting on the inertia blocks 21, which are extended by the ties 20, and with the last tie being supported on the back 4, near the fixing of this back 4 to the casing 5, the center of the back is relieved of major stresses at the firing instant since the last sub-munition does not lie on it.

Figure 9:
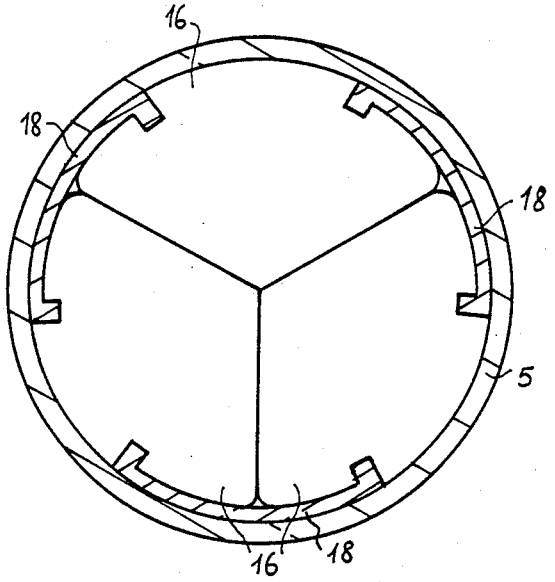
FIG. 9 shows a first alternative embodiment of the system according to the invention.

Referring now to FIG. 9, it could be envisaged that various parts 16 can be placed in a casing 5, not arranged in stages placed against one another but packed together and positioned with respect to one another as in a bundle. In this case, notches are provided in each of these parts 16 so that the U-bracket 18 can be hooked to the inside, thus holding said parts. The dropping can be done in exactly the same way, with each U-bracket having an inertia block similar to the one described earlier.

Figure 10:
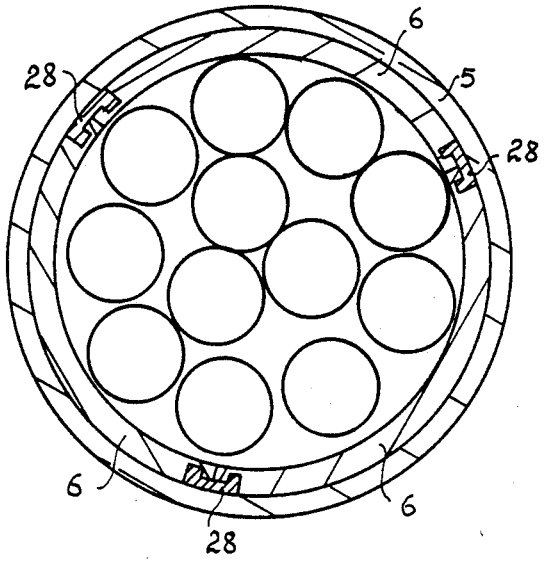
FIG. 10 shows a second alternative embodiment of the system according to the invention.

Following the same line of thinking, and with reference to FIG. 10, it is also planned to house a large number of sub-munitions against one another: these sub-munitions may be, for example, bombs, etc. This example still uses the casing 5 and U-brackets 20 holding the parts 6 which completely encircle the group of sub-munitions to be held, and thus also forming an intermediate casing.

The following are the advantages of the system according to the invention.

The stresses exerted on the casing are weak. The ejection pressure in translation of the sub-munitions is therefore far lower. Furthermore, it is possible to reduce the dimensions of the casing.

The ties are separated only after they have been completely removed, and prevent jamming stresses through gradual angular separation during removal, as shown in FIG. 5.

There is the possibility of low-cost manufacturing, for example using forming processes, to make, especially, the U-brackets, their inertia blocks and the ties when these parts are manufactured separately.

The embodiments described in FIGS. 8 and 9 can enable assymetrical locking and dropping so as to create variable, lateral ejection of the various parts. In particular, it is possible to provide for the uneven positioning of the U-brackets around the periphery of the parts.

Finally, this system makes it easily possible to drive the entire payload, within the casing, to rotate by providing claw couplings between each tie.

Obviously, numerous modifications and variations of the present invention are possible in light of the above teachings. It is therefore to be understood that within the scope of the appended claims, the invention may be practiced otherwise than as specifically described herein.

What is claimed is:

1. A system for holding a payload consisting of multiple warheads, placed in a missile, that rotates on its longitudinal axis, and dropped, in trajectory, through an end of said missile, said payload comprising:

at least one stage, which includes at least two distinct parts which have to be separated at the moment of dropping, said missile comprising a casing within which the said payload is placed, said system comprising, for each stage, means for fixing the parts of said stage so that each stage forms a compact unit so as to make longitudinal translation in said casing of said payload easier and with lower stress, said fixing means being retractable at the moment when the parts are dropped; and means connected to said fixing means for ejecting said fixing means.

2. A system according to claim 1 wherein said fixing means comprises a plurality of U-shaped sections each of which comprise U-brackets, placed around each stage for forming a compact unit, and comprising at least two fixing sides, each of said sides entering a peripheral hollow corresponding to one of the said parts, said U-brackets including means for holding parts of one and the same stage before dropping operation.

3. A system according to claim 2 wherein said U-brackets are held by the casing before the dropping operation and are spread out during the dropping operation by the centrifugal force so as to detach the U-brackets from said parts of one and the same stage.

4. A system according to claim 3 wherein the means for the ejection of said U-brackets comprise, for each U-bracket, an inertia block which is rigidly fixed to a corresponding U-bracket, at an end portion of said U-bracket for being removed from the casing after a corresponding U-bracket, and then being subject it to centrifugal force due to its mass.

5. A system according to claim 3 wherein the means for the ejection of said U-brackets comprise, for each U-bracket, an inertia block having a ring shaped groove which is deep enough to enable a projecting ring-shaped part of said U-bracket to penetrate said groove so as to be removed from the casing after removal of its a corresponding U-bracket, so as to store kinetic energy due to rotation during outward travel, and to then separate the U-bracket from parts held thereby before the dropping operation.

6. A system according to claim 2 wherein the U-brackets have fixed sides joined to each other by a central part which has a dovetail shape.

7. A system according to claim 1 wherein each stage consists of a central sub-munition, placed coaxially along the longitudinal axis of the missile, and of a plurality of ties that surround said sub-munition and are held in place by the U-brackets.

8. A system according to claim 7 wherein, in each stage, the sub-munition is only partially surrounded along its length by the ties of its corresponding stage and is partially surrounded by the ties of the adjacent stage.

9. A system according to claim 4 wherein said inertia blocks of the U-brackets have a continuous circular ring shape.

10. A system according to any of the claim 1 wherein the parts constituting said stage are placed in bundles inside the casing.

11. A system according to claim 4 wherein the inertia blocks form a support for the sub-munition.

12. A system according to claim 11 wherein on the last sub-munition, the section of the inertia block forming the support of the sub-munition has its extension on the casing enabling a reduction in stresses on the casing upon firing.

* * * * *